US012312885B2

(12) United States Patent
Aleid

(10) Patent No.: US 12,312,885 B2
(45) Date of Patent: May 27, 2025

(54) REDUCING FLUID LOSS WITH LOST CIRCULATION MATERIALS

(71) Applicant: Saudi Arabian Oil Company, Dhahran (SA)

(72) Inventor: Abdulrahman K. Aleid, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 225 days.

(21) Appl. No.: 17/833,158

(22) Filed: Jun. 6, 2022

(65) Prior Publication Data

US 2023/0392458 A1 Dec. 7, 2023

(51) Int. Cl.
*E21B 21/00* (2006.01)
*E21B 21/08* (2006.01)

(52) U.S. Cl.
CPC ..... *E21B 21/003* (2013.01); *E21B 21/08* (2013.01)

(58) Field of Classification Search
CPC ..... E21B 21/08; E21B 21/00; E21B 21/003
See application file for complete search history.

(56) References Cited

U.S. PATENT DOCUMENTS 8,312,920 B2 11/2012 Tehrani et al.
10,035,941 B2 7/2018 Whitfill et al.
10,260,295 B2 4/2019 Zhou
2013/0341091 A1* 12/2013 Sugiura ..... E21B 45/00 175/24
2018/0274312 A1* 9/2018 Zhou ..... E21B 43/08
2019/0257973 A1* 8/2019 AlBahrani ..... E21B 29/10
2020/0173272 A1* 6/2020 Themig ..... E21B 34/142
2020/0208494 A1* 7/2020 Lowry ..... E21B 43/082
2020/0248512 A1* 8/2020 Hitchcock ..... E21B 47/10
2021/0047551 A1* 2/2021 Shirley ..... E21B 43/255
2021/0172270 A1* 6/2021 Li ..... E21B 33/13
2021/0180422 A1* 6/2021 Alouhali ..... E21B 17/00
2021/0189811 A1* 6/2021 Harbi ..... C09K 8/516

* cited by examiner

*Primary Examiner* — Yanick A Akaragwe
(74) *Attorney, Agent, or Firm* — Fish & Richardson P.C.

(57) ABSTRACT

A wellbore assembly that includes a drill string and a housing. The drill string defines a first fluid pathway extending from the drill string, through the drill bit, and out the drill bit to flow a first lost circulation material. The housing stores a second lost circulation material including at least one parameter different from the first lost circulation material. The drill string defines a second fluid pathway extending from the drill string, through the housing, and out the housing to direct, with the first fluid pathway blocked, fluid along the second fluid pathway to flow the second lost circulation material out the housing to a lost circulation zone of the wellbore. The drill string directs, with the second fluid pathway blocked, fluid along the first fluid pathway to flow the first lost circulation material out the drill bit to the lost circulation zone to plug the lost circulation zone.

20 Claims, 8 Drawing Sheets

REDUCING FLUID LOSS WITH LOST CIRCULATION MATERIALS

FIELD OF THE DISCLOSURE

This disclosure relates methods and equipment for preventing lost circulation in wellbores during drilling operations.

BACKGROUND OF THE DISCLOSURE

Lost circulation occurs when drilling fluid such as drilling mud flows into one or more fractures of geological formations instead of returning up the annulus of the wellbore. Lost circulation can cause mud waste, dry drilling, and other downhole problems. Preventing lost circulation can save time and resources by keeping the drilling mud from leaving through formation fractures.

SUMMARY

Implementations of the present disclosure include a wellbore assembly that includes a drill string and a housing. The drill string includes a drill bit and is disposed within a wellbore. The drill string defines, with the drill bit, a first fluid pathway extending from the drill string, through the drill bit, and out the drill bit. The wellbore assembly flows a first lost circulation material along the first fluid pathway. The housing is coupled to an outer surface of the drill string and resides uphole of the drill bit. The housing defines a volume between the outer surface of the drill string and a wall of the housing. The housing stores a second lost circulation material including at least one parameter different from the first lost circulation material. The drill string defines, with the housing, a second fluid pathway extending from the drill string, through the housing, and out the housing. The drill string directs, with the first fluid pathway blocked, fluid along the second fluid pathway to flow the second lost circulation material out the housing to a lost circulation zone of the wellbore. The drill string directs, after flowing the second lost circulation material to the lost circulation zone and with the second fluid pathway blocked, fluid along the first fluid pathway to flow the first lost circulation material out the drill bit to the lost circulation zone to plug the lost circulation zone.

In some implementations, the wellbore assembly also includes a ball sit residing along the first fluid pathway and a movable gate residing along the second fluid pathway. The ball sit receives a ball deployed from a terranean surface of the wellbore to block the first fluid pathway and the gate moves to open the second fluid pathway. In some implementations, the movable gate includes a sleeve movable to expose or cover apertures of the drill string. In some implementations, the first circulation material is flown, with the first fluid pathway opened, from the terranean surface of the wellbore, through the drill string and the drill bit, to the lost circulation zone.

In some implementations, the at least one parameter includes an average size of lost circulation material particles. The average size of the lost circulation material particles of the second lost circulation material is greater than an average size of the lost circulation material particles of the first lost circulation material. In some implementations, the average size of the lost circulation material particles of the second lost circulation material is at least twice the average size of the lost circulation material particles of the first lost circulation material.

In some implementations, the housing includes a fluid outlet and is disposed around the drill string. The housing is fluidly coupled, through one or more apertures of the drill string, to a bore of the drill string such that the second fluid pathway extends from the one or more apertures to the fluid outlet of the housing to exit the housing. In some implementations, the second lost circulation material is disposed along the second fluid pathway such that fluid flowing through the second fluid pathway moves the second lost circulation material out the housing through the fluid outlet.

In some implementations, the wellbore assembly also includes a packer attached to the drill string and residing uphole of the housing. The packer expands to further seal or plug the lost circulation zone. In some implementations, the packer is activated by at least one of fluidic pressure, mechanical movement of the drill string, or an activation tool deployed from a terranean surface of the wellbore, through the drill string, to an inner activation component of the packer.

In some implementations, the wellbore assembly also includes nozzles fluidly coupled to the drill string and residing at a surface of the drill string or the housing. The nozzles receive a sealant from the drill string and jet or spray the sealant to the lost circulation zone to fluidly seal the lost circulation zone.

In some implementations, the wellbore assembly also includes one or more cameras residing at a surface of the drill string or the housing. The one or more cameras generate data representing an image of the lost circulation zone. The one or more camera transmit the data to a receiver at or near a terranean surface of the wellbore.

In some implementations, the housing is attached to one of a drill collar or a drill sub of a bottom hole assembly attached to the drill string.

Implementations of the present disclosure also include a wellbore assembly that includes a drill string and a housing. The drill string is disposed within a wellbore. The drill string includes a fluid port and defines a first fluid pathway extending from the drill string, through the fluid port, and out the drill string. The wellbore assembly configured to flow a first lost circulation material along the first fluid pathway. The housing is coupled to the drill string and it defines a volume to store a second lost circulation material. The drill string defines, with the housing, a second fluid pathway extending from the drill string, through the housing, and out the housing. The drill string directs, with the first fluid pathway blocked, fluid along the second fluid pathway to flow the second lost circulation material out the housing to a lost circulation zone of the wellbore. The drill string directs, with the second fluid pathway blocked, fluid along the first fluid pathway to flow the first lost circulation material out the fluid port to the lost circulation zone.

In some implementations, the wellbore assembly also includes a ball sit residing along the first fluid pathway and a movable gate residing along the second fluid pathway. The ball sit receives a ball deployed from a terranean surface of the wellbore to block the first fluid pathway. The gate moves to open and close the second fluid pathway.

In some implementations, the first lost circulation material includes particles including a first average size, and the second lost circulation material includes particles including a second average size greater than the first average size.

In some implementations, the wellbore assembly also has a camera residing at a surface of the drill string or the housing. The camera is arranged such that, with the housing positioned at the lost circulation zone, the lost circulation zone is within a field of view of the camera. The camera generates data representing an image of the lost circulation zone, from which a human operator or a processor communicatively coupled to the camera determines at least one of (a) a condition of the lost circulation zone, (b) whether a sealing operation is required, or (c) a parameter of a lost circulation material to be used to perform a sealing operation.

Implementations of the present disclosure also include a method of plugging a wellbore. The method includes disposing, within a wellbore, a drill string including a housing and defining a first fluid pathway extending from the drill string, through a drill bit of the drill string, and out the drill bit. The drill string directs a first lost circulation material along the first fluid pathway. The housing defines a volume to store a second lost circulation material. The drill string defines, with the housing, a second fluid pathway extending from the drill string, through the housing, and out the housing. The method also includes blocking the first fluid pathway. The method also includes flowing, with the first fluid pathway blocked, fluid along the second fluid pathway to flow the second lost circulation material out the housing to a lost circulation zone of the wellbore. The method also includes blocking the second fluid pathway. The method also includes flowing, with the second fluid pathway blocked, fluid along the first fluid pathway to flow the first lost circulation material out the drill bit to the lost circulation zone.

In some implementations, the drill string further includes one or more cameras residing at a surface of the drill string or the housing. The drill string also has multiple nozzles fluidly coupled to the drill string and residing at a surface of the drill string or the housing. The method further includes, after flowing the fluid along the second fluid pathway to flow the second lost circulation material, spraying, through the nozzles, a sealant to the lost circulation zone to fluidly seal the lost circulation zone. The method also includes determining, based on data generated by the camera representing an image of the lost circulation zone, at least one of (a) a condition of the lost circulation zone, (b) whether a sealing operation is required, or (c) a parameter of a lost circulation material to be used to perform a sealing operation.

In some implementations, the drill string also has a packer attached to the drill string and the determination includes determining that a further sealing operation is required. The method also includes, after spraying the sealant, expanding the packer to further seal or plug the lost circulation zone.

DETAILED DESCRIPTION OF THE DISCLOSURE

During the drilling of a wellbore, lost circulation (also called loss of circulation) can occur when drilling mud or other fluids enter a naturally occurring (or induced) fracture in the formation. The lost circulation can also occur, for example, due to a crack, hole, void, downhole reservoir, or a region of high porosity. The present disclosure relates to a wellbore assembly 100 and methods used to prevent or reduce lost circulation. The plugging assembly 100 allows the use of two or more different types of lost circulation material (LCM) while using a conventional drill bit to create a bridge or a plug and stop the lost circulation.

Particular implementations of the subject matter described in this specification can be implemented so as to realize one or more of the following advantages. For example, the wellbore assembly of the present disclosure can save time and resources by preventing drilling mud from leaving the wellbore through small, medium, and large fractures of the formation. The present disclosure features an LCM housing that is compatible with conventional drill strings, allowing the wellbore assembly to be implemented quickly and efficiently. Additionally, the wellbore assembly can be used to stop losses before running the casing, which enhances the cementing operation of wellbore casing to increase the life of the well and prevent any behind casing communication. The wellbore assembly can also be quickly deployed without the need of specialized personnel.

Figure 1:
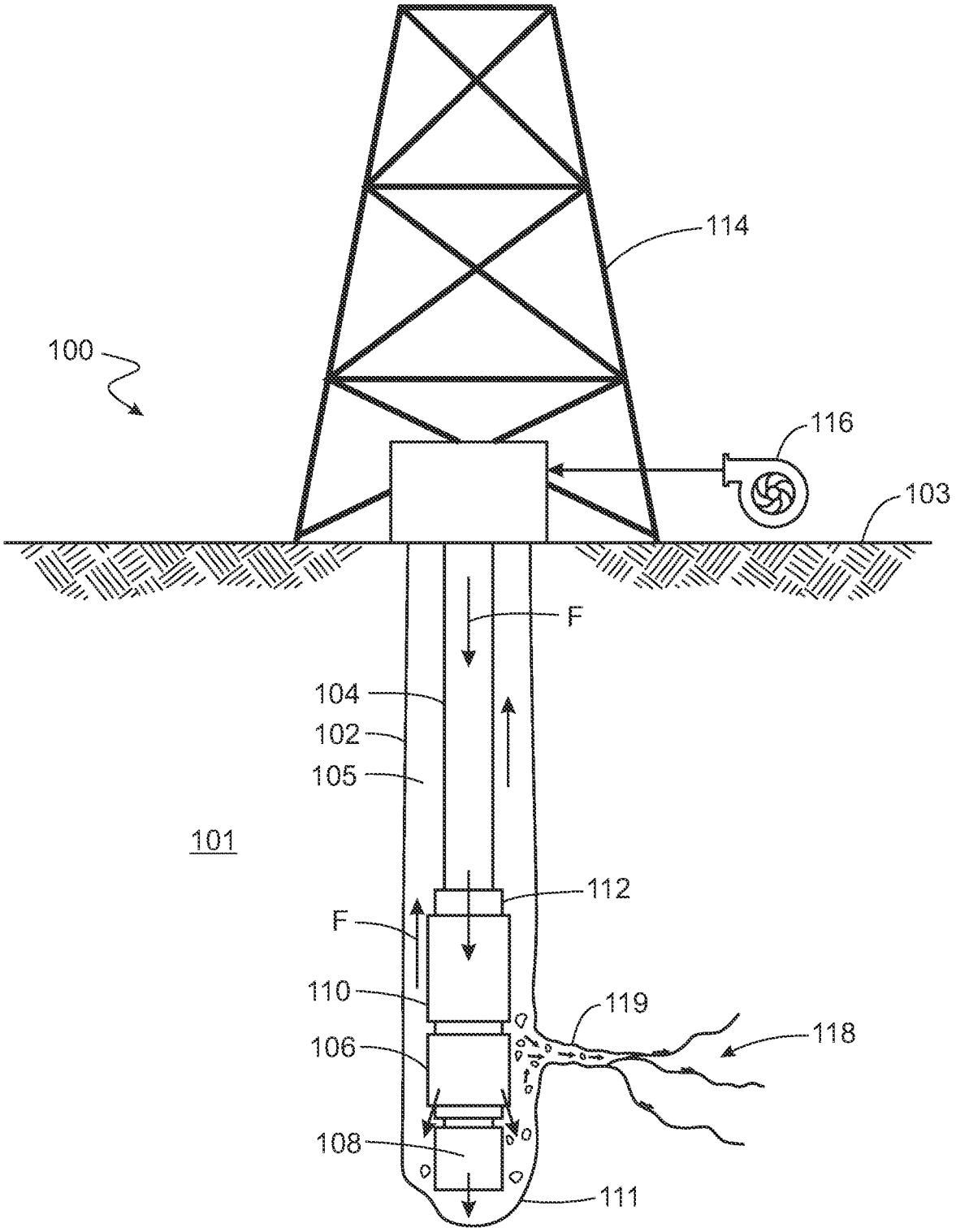
FIG. 1 is a schematic view, partially cross-sectional, of a wellbore assembly disposed within a wellbore.

FIG. 1 shows a wellbore assembly 100 disposed within a wellbore 102 (e.g., a horizontal or non-vertical wellbore) formed in a geologic formation 101. The geologic formation 101 can include a hydrocarbon reservoir from which hydrocarbons can be extracted. The wellbore 102 extends from a surface 103 (e.g., a terranean surface) of the wellbore 102 to a downhole end 111 of the wellbore 102.

The wellbore assembly 100 includes a drill string 104 and a housing or bank 106 attached to the drill string 104. In some implementations, the housing 106 can be part of the drill string 104. The drill string 104 can be attached to a rig 114 at the terranean surface 103 of the wellbore. The drill string 104 forms, with a wall of the wellbore 102, an annulus 105.

The drill string 104 has a drill bit 108 that cuts through the formation 101 to form the wellbore 102. The drill string 104 can flow fluid "F" (e.g., drilling mud) to aid during the drilling operation or for other purposes. During drilling, lost circulation can occur due to damage to the formation, characteristics of the formation, or for other reasons. For example, the wellbore 102 can have a lost circulation zone 118 that may include fractures 119, cracks, holes, voids, regions of high porosity, etc. Lost circulation occurs when all or part of the drilling fluid "F" flows into one or more geological formations instead of returning up the annulus 105.

The drill string 104 can flow fluid (e.g., drilling mud) with LCM and sealants to plug the lost circulation zone 118 of the wellbore 102. The drill string 104 flows the fluid and the LCM from the terranean surface 103 of the wellbore to the downhole end 111 of the wellbore 102. For example, the drill string 104 can be fluidly coupled to a surface pump 116 and receive, from the pump 116, the fluid, LCM, and sealants to plug the wellbore. In some implementations, the LCM and sealant can be introduced into the drill string 104 from a location downstream of the pump 116. The LCM can include organic or synthetic particles, and different concentrations can be used. The LCM forms a pile or a plug to stop or reduce the losses in formation fractures.

The drill string 104 can also have a bottom hole assembly (BHA) 112. The housing 106 can be attached to one of a drill collar or a drill sub or another component of the BHA 112. In some implementations, the drill bit 108 and/or the housing 106 can be part of the BHA 112. The drill string 104 also has an expandable tube 110 (e.g., a packer) that can be used to further seal or plug the wellbore 102. The expandable tube 110 can be attached to or part of the BHA 112.

Figure 2:
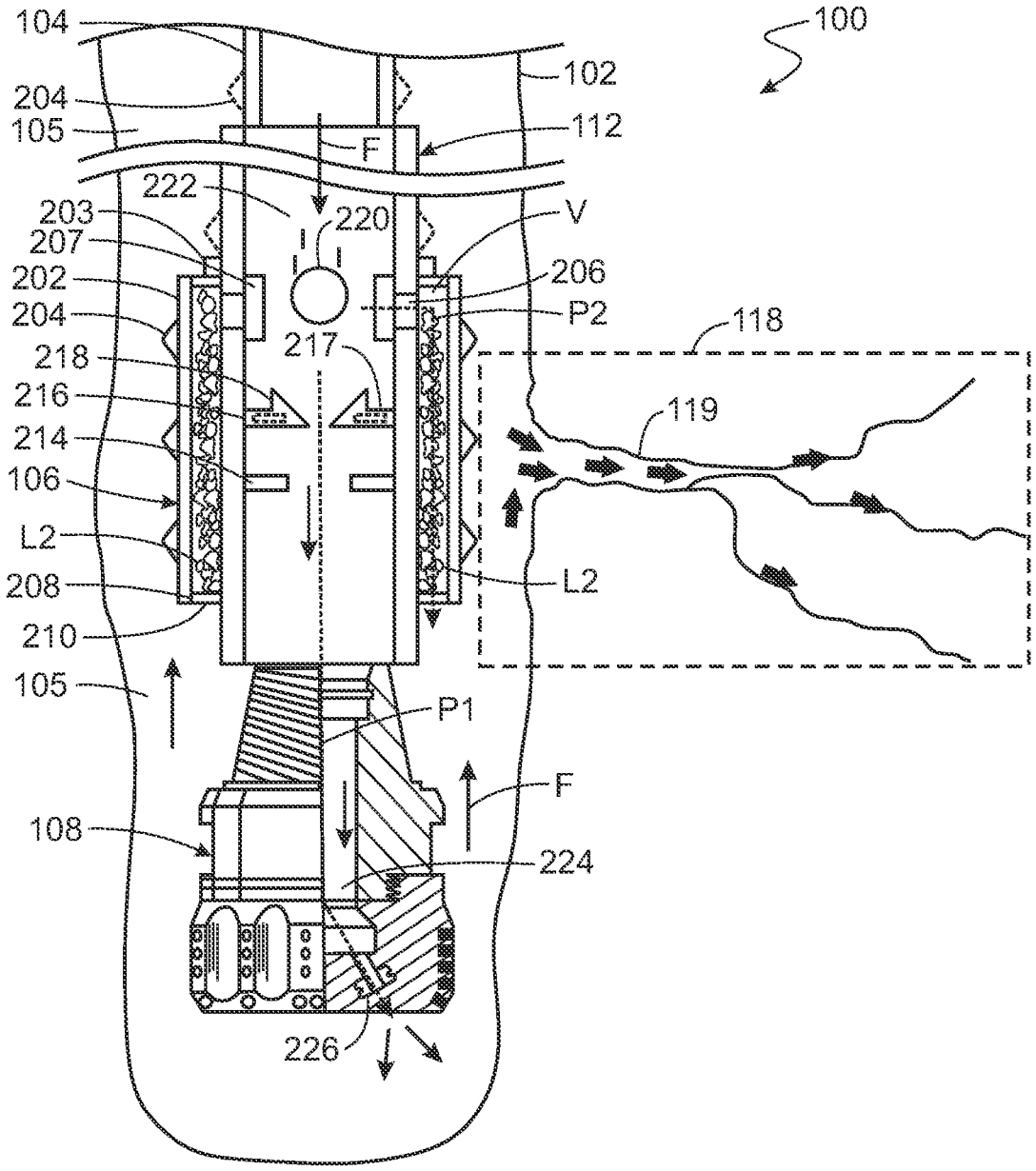
FIGS. 2-7 are front schematic views, partially cross-sectional, of sequential steps of plugging a wellbore.

FIGS. 2-7 show a sequence of steps for plugging or partially plugging the wellbore 102. Referring to FIG. 2, the wellbore assembly 100 also includes a ball sit 218, a ball sit retainer 216, ball sit catcher 214, nozzles 204, and cameras 203 to aid during the remedial or plugging operation.

The wellbore assembly 100 defines a first fluid pathway "P1" and a second fluid pathway "P2." The first fluid pathway "P1" extends from the drill string (or from the BHA 112), through the drill bit 108, and out the drill bit 108 through a fluid outlet 226 of the drill bit 108. The fluid outlet 226 can be, for example, a nozzle at the end of a bore 124 or an internal fluid channel of the drill bit 108. In some implementations, the drilling fluid "F" can exit through another fluid outlet (in addition to or instead of through the nozzles) such as a fluid port in the wall of the drill string 104. The drill bit 108 can be a conventional drill bit with one or more fluid nozzles, such as a rolling cutter drill bit, a fixed cutter drill bit, or a hybrid cutter bit. As further described in detail below with respect to FIG. 4, the drill string 104 flows, with the drilling fluid and through the first fluid pathway "P1," a first LCM that has particles small enough to flow through the narrow fluid outlet 226 of the drill bit 108.

As depicted in FIG. 2, the housing 106 can be arranged as an outer housing or reservoir attached to an external surface of the drill string 104 (or the BHA 112). The housing 106 resides uphole of the drill bit 108 and has an annular volume "V" defined between the external surface of the drill string 104 and a tubular wall 202 of the housing disposed about the drill string 104. In some implementations, the drill string can have multiple housings 106 each able to open independently to flow their respective second LCM "L2." For example, the drill string can have multiple ball seats of sequentially smaller diameter to allow multiple balls to be dropped and sequentially flow the second LCM "L2" of each housing. The housing 106 stores, within its volume "V," a second LCM "L2" that has at least one parameter different from the first LCM. The second LCM "L2" has a parameter or characteristic that makes it unsuitable to be flown through the nozzles 226 of the drill bit 108. For example, the second LCM "L2" has particles that are larger than what could flow through the drill bit nozzles. In other words, the average size of the particles of the second LCM "L2" is greater than the average size of the particles of the first LCM "L1" (see FIG. 4) that is flown through the drill bit 108.

The housing 106 (or the drill string 104) has a first gate 207 and a second gate 208 that move to open or close the second fluid pathway "P2." The first gate 207 moves to cover or expose one or more apertures 206 of the drill string 104. The second gate 207 moves to open or close a fluid outlet 210 at the bottom of the housing 106. Thus, with the gates opened, the second fluid pathway "P2" extends from the drill string 104 (e.g., the bore 222 of the drill string 104), through the housing 106, and out the housing 106 through the fluid outlet 210 of the housing.

The gates 207, 208 can be moved by an actuator (not shown) or by fluidic pressure pushing on the gates 207, 208. For example, the first gate 207 can be a spring-loaded sleeve that moves downhole under fluid pressure or by an actuator (not shown) controlled from the surface to expose the fluid ports. The second gate 208 can be similarly pushed open by fluidic pressure or by an actuator.

The nozzles 204 can be attached to the housing 106 and be fluidly coupled t the drill string 104 through the aperture 206 of the drill string 104. As further described in detail below with respect to FIG. 5, the housing nozzles 204 can be used to spray a sealant to the accumulated LCM to further seal the wellbore 102. In some implementations, the nozzles 204 can be attached to another component of the wellbore assembly 100, such as to the drill string 104 or to the BHA 112.

The cameras 203 can be used before, during, or after flowing the LCM to aid during the plugging wellbore operation. For example, the cameras 203 residing at a surface of the drill string 104 (or the BHA 112) or the housing 106 and are arranged such that, with the BHA 112 positioned at the lost circulation zone 118, the lost circulation zone 118 is within a field of view of the camera 203. The camera 203 generates data (e.g., a picture) representing an image of the lost circulation zone 118. The camera 203 transmits the data to a receiver at or near a terranean surface of the wellbore. Based on that data, a human operator or a processor communicatively coupled to the camera 203 determines steps to be taken during the plugging operation. For example, based on the data, one can determine a condition and location of the lost circulation zone and one can determine whether a sealing operation is required. One can also determine parameters (e.g., size, amount, concentration, type, etc.) of the LCM to be used to perform a sealing operation. The camera can transmit live video or real-time images to the surface to allow an operator or an automatic rig to know where to position the BHA 112 to perform the plugging operation.

Still referring to FIG. 2, when the drilling fluid "F" is lost during drilling, the drilling fluid "F" is lost at the lost circulation zone 118. In other words, the drilling fluid "F" leaves the wellbore through one or more formation fractures 119 at the lost circulation zone 118 instead of returning to the surface through the annulus 105. Upon determining that the drilling fluid "F" is being lost at a downhole location of the wellbore 102, the drill string 104 can continue to drill downhole of the lost circulation zone 118 to move the BHA 112 to a desired position with respect to the lost circulation zone 118. For example, the drill string 104 can position the BHA 112 so that the camera 203 is sufficiently near the lost circulation zone 118 to capture an image of the lost circulation zone 118. The image can be generated before beginning a plugging operation to determine the size of the fracture 119 and thus the amount and type of LCM to be used. Additionally, the drill string 104 can position the BHA 112 so that the fluid outlet 210 of the housing 106 is near the lost circulation zone 118 and thus reduce the distance that the second LCM "L2" has to travel to the lost circulation zone 118.

The ball sit 218 resides along the first fluid pathway "P1" such that, with a ball 220 sitting on the ball sit 218, the ball 220 blocks the first fluid pathway "P1." The ball sit 218 can be releasably attached (e.g., through shear pins 217) to an annular ball sit retainer 216 (e.g., an annular shoulder). When the shear pins 217 break, the ball sit 218 can land on the ball sit catcher 214 (e.g., one or more pins or arms), which allows fluid to flow through it to move along the first fluid pathway "P1."

To begin a plugging operation, the ball 220 is dropped from the surface of the wellbore 102 to land on the ball sit 218 and block the first fluid pathway "P1." The ball sit 218 is attached to the ball seat retainer 216 with a connection sufficiently strong to undergo fluid pressure sufficient to activate the gates 207, 208 and to flow the second LCM "L2" without breaking.

Figure 3:
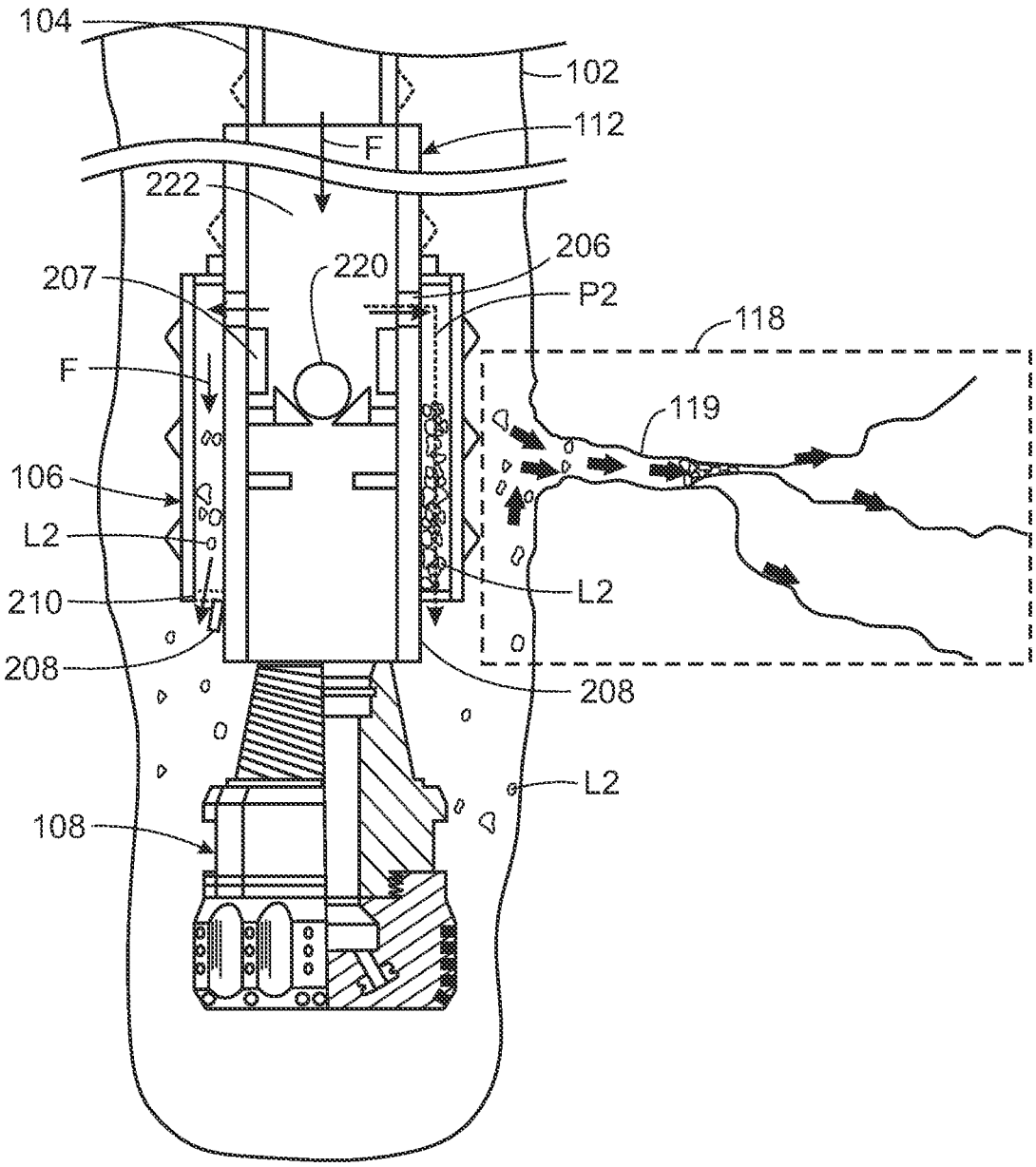

Referring now to FIG. 3, with the first fluid pathway "P1" closed, the gates 207, 208 are opened to open the second fluid pathway "P2." For example, the first gate can be a spring-loaded gate that moves downward to expose the apertures 206 and the second gate 208 can pivot to open the fluid outlet 210 of the housing 106. The gates 207, 208 can be, for example, sliding gates, hinged gates, or frangible gates. In implementations in which the housing 106 has multiple bore gates 208, the gates can be opened separately or simultaneously. With the second fluid pathway "P2" opened, the drilling fluid "F" flows along the second fluid pathway "P2" to move the second LCM "L2" toward the lost circulation zone 118. Specifically, the second LCM "L2" is disposed along the second fluid pathway "P2" such that fluid flowing through the second fluid pathway "P2" moves the second LCM "L2" out the housing 106 through the fluid outlet 210 of the housing. The second LCM "L2" flows toward the lost circulation zone 118 into the fracture 119 to begin plugging the fracture 119. The second LCM "L2" can have coarse or large particles that would not normally be able to be flown through the drill bit 108. The particle type and size of the second LCM "L2" can be based on at least one of the size of the annulus 105, the diameter of the wellbore 102, the diameter of the drill string 104, and the aperture size (or severity) of the fracture 119. For example, the second LCM "L2" can be at least twice (e.g., in diameter or in volume) the size of the first LCM "L1." For example, the average particle size of the second LCM "L2" can be twice (or three, four, five, or more times) the average size of the particles of the first LCM "L1."

The second LCM "L2" prevents the small particles of the first LCM "L1" from being lost into the formation. For example, the second LCM "L2" forms a first plug in the fracture 119 to form a kind of "bridge" for the first LCM "L1" to build on and accumulate on top of to further plug the formation. In other words, the second LCM "L2" plugs the larger openings and forms a partial plug that is complemented by the first LCM "L1" to complete or partially complete the plug. Thus, the large LCM "L2" forms a base at the formation fracture for any fluid-loss control material such as a granular material to build up and form a plug.

Once the second LCM "L2" has been flown to the fracture 119, the gates 207, 208 of the housing 106 can be closed to block the second fluid pathway "P2." The second fluid pathway "P2" is blocked to then flow the second LCM "L2." To close the gates 207, 208, the drill string 104 can be depressurized or an actuator moving the gates can mechanically move the gates to the closed position.

Figure 4:
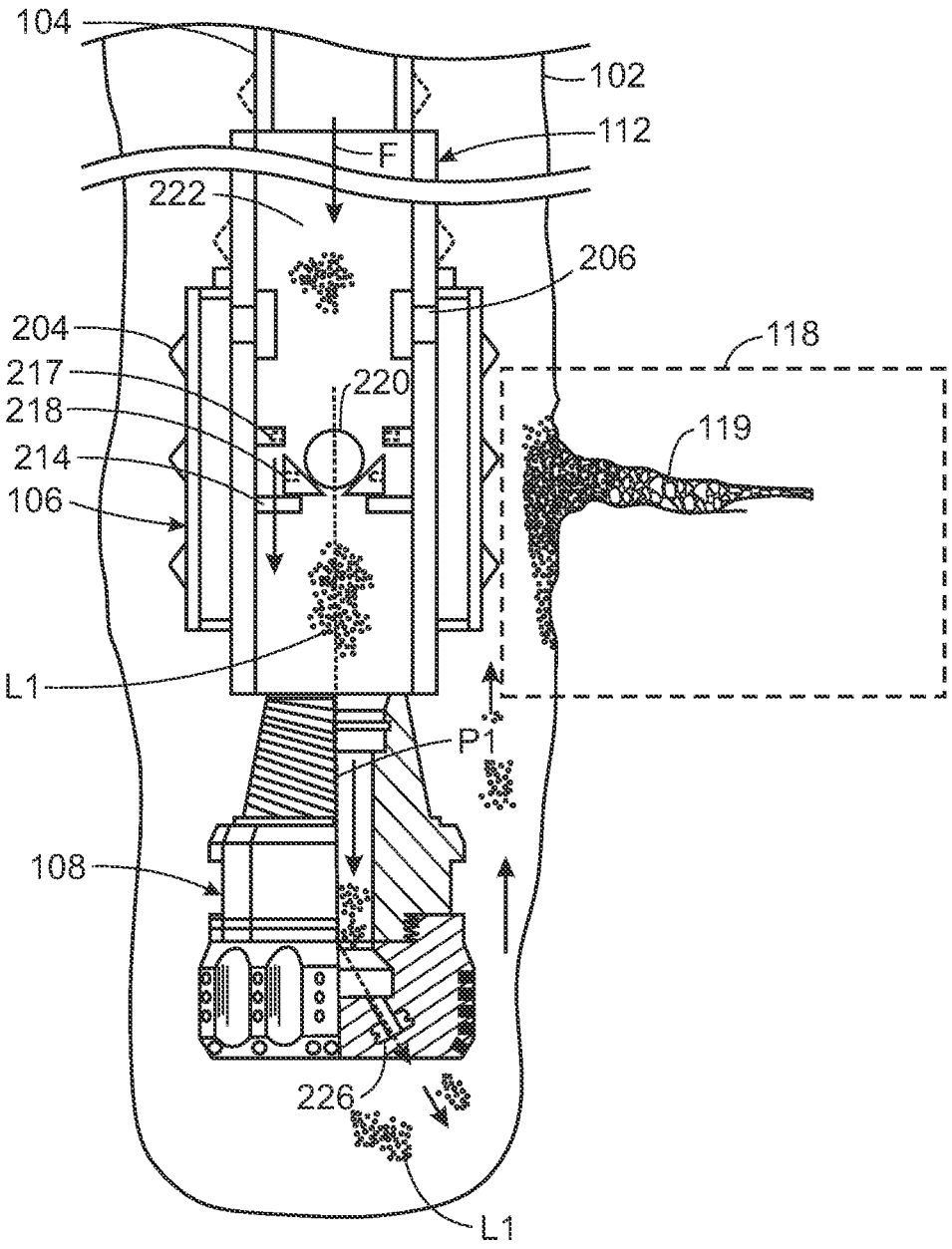

Referring now to FIG. 4, with the second fluid pathway "P2" closed, fluid pressure is applied to the ball sit 218 to shear off the pins 217 and detach the ball sit 218 from the ball sit retainer. With the ball sit 218 (and the ball 220) detached from the retainer, the ball sit 21 lands on the ball sit catcher 214. With the ball sit 218 supported on the ball sit catcher 214, the first fluid pathway "P1" is opened. Once the first fluid pathway "P1" is opened and the second fluid pathway "P2" is closed, the drilling fluid "F" flows along the first fluid pathway "P1" to flow a first LCM "L1" out the drill bit 108 to the lost circulation zone 118 to plug the lost circulation zone 118.

The first LCM "L1" can be introduced from the terranean surface (e.g., from a surface valve or pump) of the wellbore 102 to be flown downhole, through the drill string 104, with the drilling fluid "F." The first LCM "L1" accumulates at the fracture 119 to further plug the wellbore 102. The first LCM "L1" can have fine or medium-sized particles. The size, shape, and type of particles of the first LCM "L1" can be selected based on the aperture size of the dill bit nozzles. The first LCM "L1" can cover the perms caused in the circulation zone 118 by the second LCM "L2."

Figure 5:
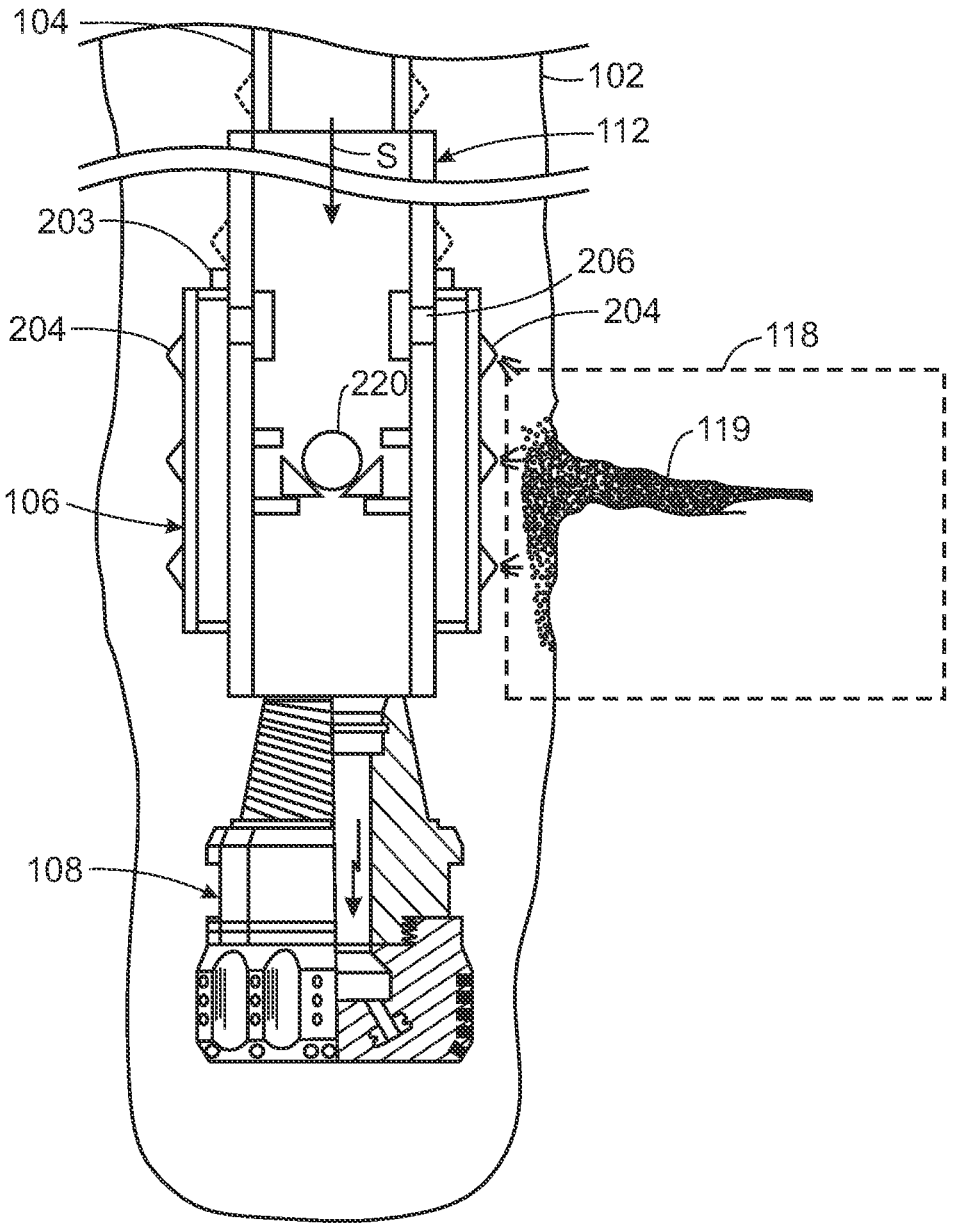

Now referring to FIG. 5, after flowing the first and second LCM materials, the wellbore can be pressure tested or the camera can capture images of the lost circulation zone 118 to determine if the wellbore 102 is fully sealed. If not fully sealed, one or more of the nozzles 204 can jet or spray a sealant "S" (e.g., a resin material) on the accumulated LCM to further plug the wellbore 102.

The nozzles 204 can move to point toward the fracture 119 or the drill string 104 can be moved to position the nozzles 204 as needed to spray the formation. In some implementations, the nozzles 204 can have movable vents (e.g., movable by a controller at the surface of the wellbore) to direct, based on the location of the fracture 119 as determined from the camera images, the sealant "S" toward the fracture 119. The sealant can be directed toward the nozzles 204 through a different fluid pathway between the drill bit and the housing, or by moving the gate 203 again using fluidic pressure or another means such as with an actuator. 106 After spraying the sealant "S," the camera 203 can capture more images of the lost circulation zone to determine the condition of the lost circulation zone and to determine whether another sealing operation is required. For example, before or after applying the sealant, more LCM can be pumped downhole to further plug the wellbore 102. In some implementations, the drill string 104 can be pulled up to refill the housing 106 with large LCM particles and continue to plug the formation with large and small LCM particles.

Figure 6:
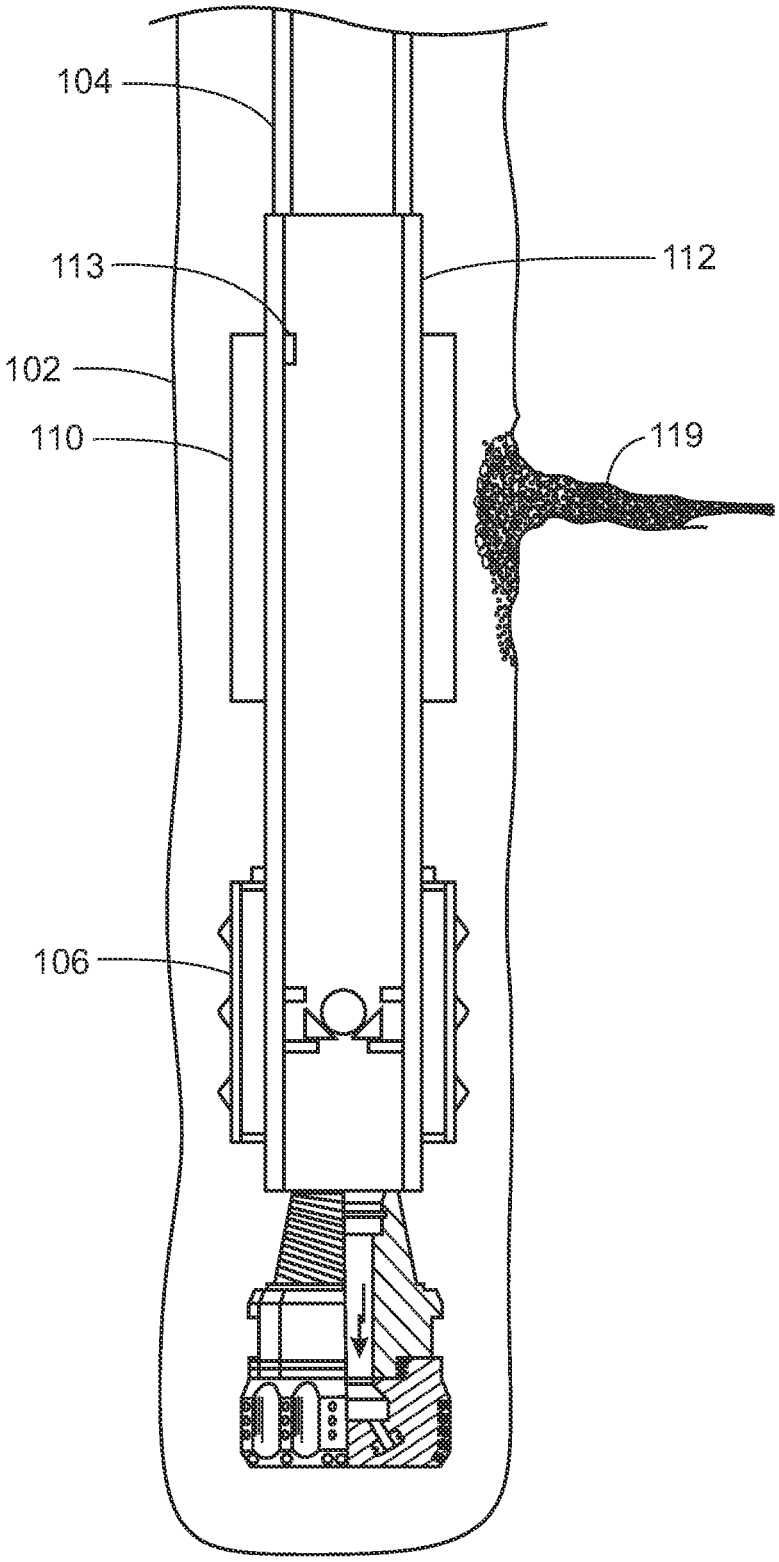
Figure 7:
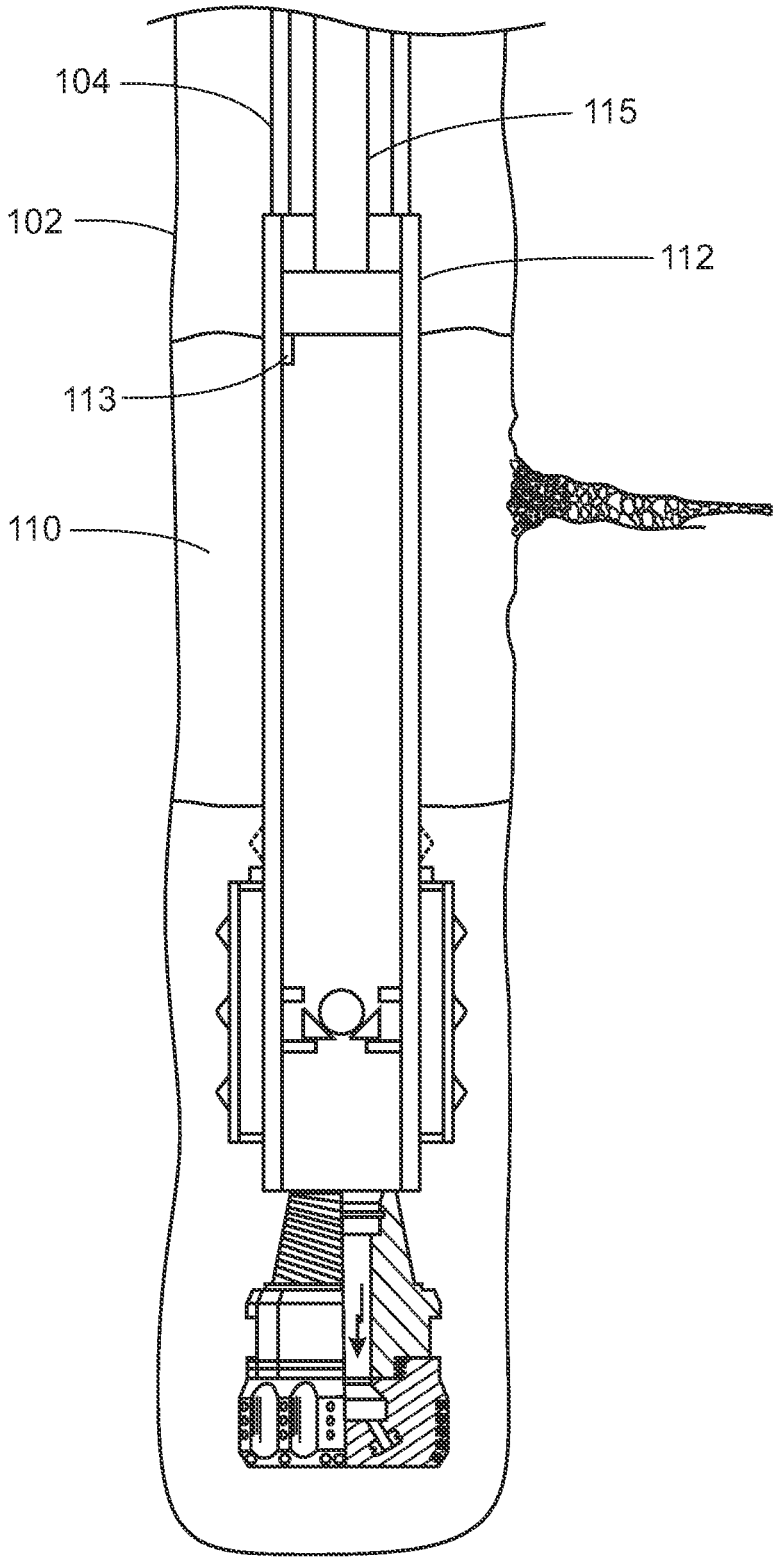

FIGS. 6 and 7 show sequential steps for further plugging or sealing the wellbore 102 in the case that the LCM and sealant did not satisfy the sealing requirements of the wellbore 102. As shown in FIG. 6, the drill string 104 can be lowered to position the expandable tube 110 next to the fracture 119 to expand the tube 110 on or near the fracture 119. The expandable tube 110 is attached to the drill string 104 (or the BHA 112) and resides uphole of the housing 106. The expandable tube 110 is activated by at least one of fluidic pressure, mechanical movement of the drill string, or an activation tool deployed from a terranean surface of the wellbore, through the drill string, to an inner activation component 113 (e.g., an electrical switch, a mechanical lever, etc.) of the expandable tube 110. For example, as shown in FIG. 7, a cone 115 can be lowered inside the drill string 104 to push or otherwise engage the activation component 113 to expand the packer and overlay the fracture 119 to further seal or plug the wellbore 102. Once the packer has been set, the drill string can detach from the packer and the housing to drill, using a second drill string, through the housing and drill bit to continue drilling.

All of the above plugging operations can be performed automatically, partially automatically, or manually. For example, the drill string 104 can be automatically moved along the wellbore by an automatic rig mechanism until the camera finds the fracture. The flowing of LCM materials can also be done automatically or with the aid of a human operator at the surface of the wellbore.

Figure 8:
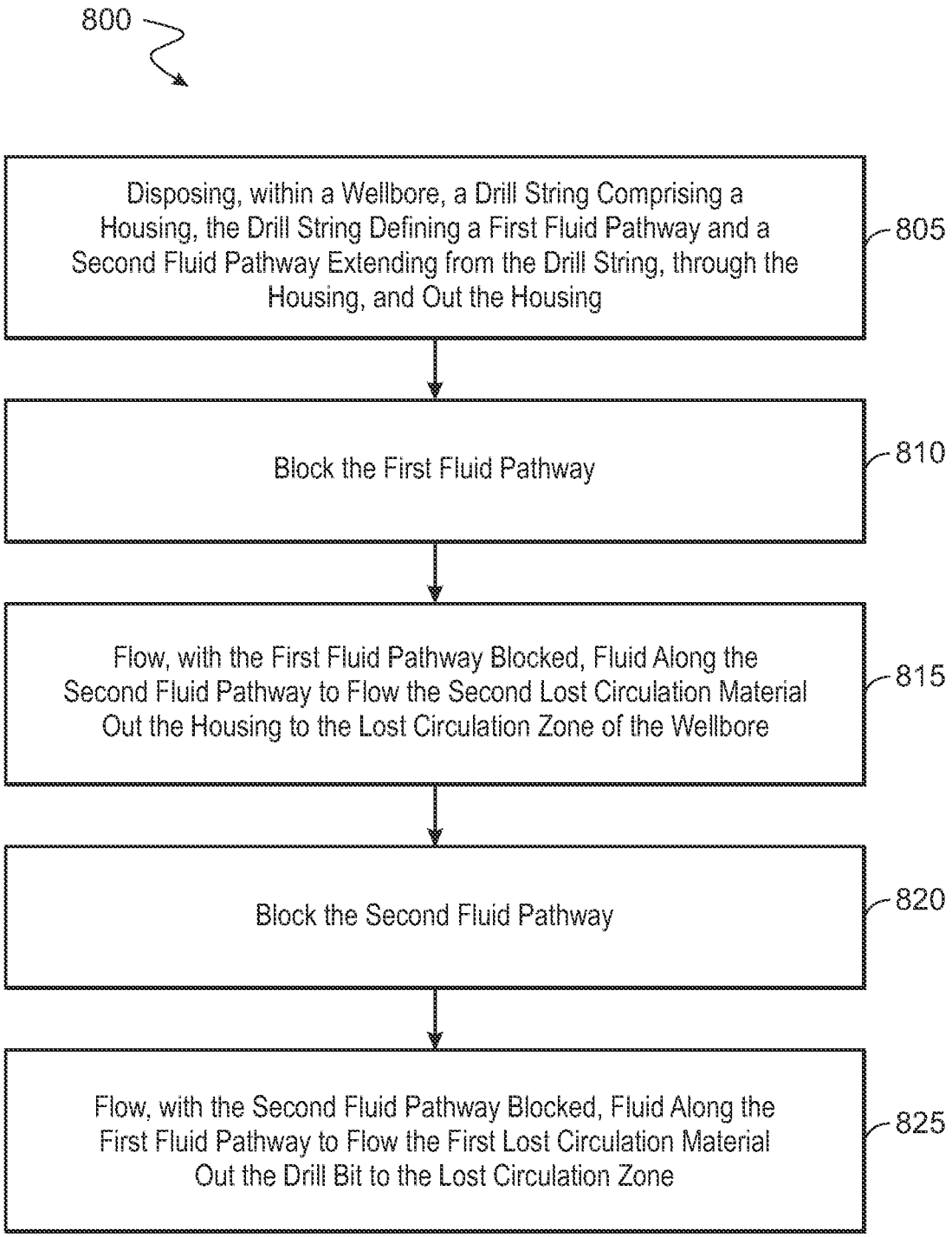
FIG. 8 is a flow chart of a method of plugging a wellbore.

FIG. 8 shows a flow chart of an example method 800 of plugging a wellbore. The method includes disposing a drill string within a wellbore. The drill string has a housing and defines a first fluid pathway extending from the drill string, through a drill bit of the drill string, and out the drill bit. The housing defines a volume configured to store a second lost circulation material. The drill string defines, with the housing, a second fluid pathway extending from the drill string, through the housing, and out the housing (805). The method also includes blocking the first fluid pathway (810). The method also includes flowing, with the first fluid pathway blocked, fluid along the second fluid pathway to flow the second lost circulation material out the housing to the lost circulation zone of the wellbore (815). The method also includes blocking the second fluid pathway (820). The method also includes flowing, with the second fluid pathway blocked, fluid along the first fluid pathway to flow the first lost circulation material out the drill bit to the lost circulation zone (825).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A wellbore assembly, comprising:

a drill string comprising a drill bit and configured to be disposed within a wellbore, the drill string configured to direct a first lost circulation material to the drill;

a housing coupled to an outer surface of the drill string and residing uphole of the drill bit, the housing defining a volume between the outer surface of the drill string and a wall of the housing and storing a second lost circulation material comprising at least one parameter different from the first lost circulation material; and a movable gate at a fluid inlet of the housing, the movable gate arranged to move between a first position, in which the volume of the housing is fluidly isolated from a bore of the drill sting, and a second position, in which the volume of the housing is in fluid communication with the bore of the drill string, the drill string defining, with the movable gate in the first position, a first fluid pathway extending from the drill string, through the drill bit, and out of the drill bit, the wellbore assembly configured to flow the first lost circulation material along the first fluid pathway, the drill string defining, with the movable gate in the second position, a second fluid pathway extending from the drill string, through the housing, and out of the housing;

wherein the drill string is configured to direct, with the first fluid pathway blocked, fluid along the second fluid pathway to flow the second lost circulation material out of the housing to a lost circulation zone of the wellbore, and the drill string is configured to direct, after flowing the second lost circulation material to the lost circulation zone and with the second fluid pathway blocked, fluid along the first fluid pathway to flow the first lost circulation material out of the drill bit to the lost circulation zone to plug the lost circulation zone.

2. The wellbore assembly of claim 1, further comprising a ball sit residing along the first fluid pathway, the ball sit configured to receive a ball deployed from a terranean surface of the wellbore to block the first fluid pathway and the movable gate configured to move to open the second fluid pathway.

3. The wellbore assembly of claim 1, wherein the movable gate comprises a sleeve movable to expose or cover apertures of the drill string.

4. The wellbore assembly of claim 1, wherein the first lost circulation material is flowed, with the first fluid pathway opened, from the terranean surface of the wellbore, through the drill string, to the lost circulation zone.

5. The wellbore assembly of claim 1, wherein the at least one parameter comprises an average size of lost circulation material particles, and an average size of the lost circulation material particles of the second lost circulation material is greater than an average size of the lost circulation material particles of the first lost circulation material such that the second lost circulation material cannot flow through the first fluid pathway.

6. The wellbore assembly of claim 5, wherein the average size of the lost circulation material particles of the second lost circulation material is at least twice the average size of the lost circulation material particles of the first lost circulation material.

7. The wellbore assembly of claim 1, wherein the housing defines, with wall of the housing, an annular in which the second lost circulation material is stored, the housing comprising a fluid outlet and is disposed around the drill string, the housing fluidly coupled, through one or more apertures of the drill string, to a bore of the drill string such that the second fluid pathway extends from the one or more apertures to the fluid outlet of the housing to exit the housing.

8. The wellbore assembly of claim 7, wherein the second lost circulation material is disposed along the second fluid pathway such that fluid flowing through the second fluid pathway moves the second lost circulation material out the housing through the fluid outlet.

9. The wellbore assembly of claim 1, further comprising one or more cameras residing at a surface of the drill string or the housing, the one or more cameras configured to generate data representing an image of the lost circulation zone, the image usable to determine at least one of a condition of the lost circulation zone or a location of the lost circulation zone.

10. The wellbore assembly of claim 1, wherein the housing is attached to a bottom hole assembly attached to the drill string.

11. A wellbore assembly, comprising:

a drill string comprising a drill bit and configured to be disposed within a wellbore, the drill string defining, with the drill bit, a first fluid pathway extending from the drill string, through the drill bit, and out the drill bit, the wellbore assembly configured to flow a first lost circulation material along the first fluid pathway; and a housing coupled to an outer surface of the drill string and residing uphole of the drill bit, the housing defining a volume between the outer surface of the drill string and a wall of the housing and configured to store a second lost circulation material comprising at least one parameter different from the first lost circulation material, the drill string defining, with the housing, a second fluid pathway extending from the drill string, through the housing, and out the housing;

wherein the drill string is configured to direct, with the first fluid pathway blocked, fluid along the second fluid pathway to flow the second lost circulation material out the housing to a lost circulation zone of the wellbore, and the drill string is configured to direct, after flowing the second lost circulation material to the lost circulation zone and with the second fluid pathway blocked, fluid along the first fluid pathway to flow the first lost circulation material out the drill bit to the lost circulation zone to plug the lost circulation zone;

wherein the wellbore assembly further comprises a packer attached to the drill string and residing uphole of the housing, the packer configured to expand to further seal or plug the lost circulation zone.

12. The wellbore assembly of claim 11, wherein the packer is configured to be activated by at least one of fluidic pressure, mechanical movement of the drill string, or an activation tool deployed from a terranean surface of the wellbore, through the drill string, to an inner activation component of the packer.

13. A wellbore assembly, comprising:

a drill string comprising a drill bit and configured to be disposed within a wellbore, the drill string defining, with the drill bit, a first fluid pathway extending from the drill string, through the drill bit, and out the drill bit, the wellbore assembly configured to flow a first lost circulation material along the first fluid pathway; and a housing coupled to an outer surface of the drill string and residing uphole of the drill bit, the housing defining a volume between the outer surface of the drill string and a wall of the housing and configured to store a second lost circulation material comprising at least one parameter different from the first lost circulation material, the drill string defining, with the housing, a second fluid pathway extending from the drill string, through the housing, and out the housing;

wherein the drill string is configured to direct, with the first fluid pathway blocked, fluid along the second fluid pathway to flow the second lost circulation material out the housing to a lost circulation zone of the wellbore, and the drill string is configured to direct, after flowing the second lost circulation material to the lost circulation zone and with the second fluid pathway blocked, fluid along the first fluid pathway to flow the first lost circulation material out the drill bit to the lost circulation zone to plug the lost circulation zone;

wherein the wellbore assembly further comprises nozzles fluidly coupled to the drill string and residing at a surface of the drill string or the housing, the nozzles configured to receive a sealant from the drill string and jet or spray the sealant to the lost circulation zone to fluidly seal the lost circulation zone.

14. A wellbore assembly, comprising:

a drill string configured to be disposed within a wellbore, the drill string comprising a fluid port and configured to direct a first lost circulation material out of the drill string through the fluid port; and a housing coupled to the drill string and defining a volume storing a second lost circulation material; and a movable gate at a fluid inlet of the housing, the movable gate arranged to move between a first position, in which the volume of the housing is fluidly isolated from a bore of the drill sting, and a second position, in which the volume of the housing is in fluid communication with the bore of the drill string, the drill string defining, with the movable gate in the first position, a first fluid pathway extending from the drill string, through the fluid port, and out the drill string, the wellbore assembly configured to flow the first lost circulation material along the first fluid pathway, the drill string defining, with the movable gate in the second position, a second fluid pathway extending from the drill string, through the housing, and out the housing;

wherein the drill string is configured to direct, with the first fluid pathway blocked, fluid along the second fluid pathway to flow the second lost circulation material out the housing to a lost circulation zone of the wellbore, and the drill string is configured to direct, with the second fluid pathway blocked, fluid along the first fluid pathway to flow the first lost circulation material out the fluid port to the lost circulation zone.

15. The wellbore assembly of claim 14, further comprising a ball sit residing along the first fluid pathway, the ball sit configured to receive a ball deployed from a terranean surface of the wellbore to block the first fluid pathway and the movable gate configured to move to open and close the second fluid pathway.

16. The wellbore assembly of claim 14, wherein the first lost circulation material comprises particles comprising a first average size, and the second lost circulation material comprises particles comprising a second average size greater than the first average size.

17. The wellbore assembly of claim 14, further comprising a camera residing at a surface of the drill string or the housing, the camera arranged such that, with the housing positioned at the lost circulation zone, the lost circulation zone is within a field of view of the camera, wherein the camera is configured to generate data representing an image of the lost circulation zone, from which a human operator or a processor communicatively coupled to the camera determines at least one of (a) a condition of the lost circulation zone, (b) whether a sealing operation is required, or (c) a parameter of a lost circulation material to be used to perform a sealing operation.

18. A method comprising:

disposing, within a wellbore, a drill string comprising a housing and a movable gate configured to close to prevent fluid communication between the housing and a bore of the drill string and open to allow fluid communication between the housing and the bore of the drill string, the housing defining a first fluid pathway extending, with the gate closed, from the drill string, through a drill bit of the drill string, and out the drill bit, the drill string configured to direct a first lost circulation material along the first fluid pathway, the housing defining a volume storing a second lost circulation material, the drill string defining, with the gate opened, a second fluid pathway extending from the drill string, through the housing, and out the housing;

blocking the first fluid pathway;

opening, by opening the gate, the second fluid pathway;

flowing, with the first fluid pathway blocked, fluid along the second fluid pathway to flow the second lost circulation material out the housing to a lost circulation zone of the wellbore;

blocking the second fluid pathway; and flowing, with the second fluid pathway blocked, fluid along the first fluid pathway to flow the first lost circulation material out the drill bit to the lost circulation zone.

19. A method comprising:

disposing, within a wellbore, a drill string comprising a housing and defining a first fluid pathway extending from the drill string, through a drill bit of the drill string, and out the drill bit, the drill string configured to direct a first lost circulation material along the first fluid pathway, the housing defining a volume configured to store a second lost circulation material, the drill string defining, with the housing, a second fluid pathway extending from the drill string, through the housing, and out the housing;

blocking the first fluid pathway; and flowing, with the first fluid pathway blocked, fluid along the second fluid pathway to flow the second lost circulation material out the housing to a lost circulation zone of the wellbore;

blocking the second fluid pathway; and flowing, with the second fluid pathway blocked, fluid along the first fluid pathway to flow the first lost circulation material out the drill bit to the lost circulation zone;

wherein the drill string further comprises one or more cameras residing at a surface of the drill string or the housing, and a plurality of nozzles fluidly coupled to the drill string and residing at a surface of the drill string or the housing, the method further comprising, after flowing the fluid along the second fluid pathway to flow the second lost circulation material:

spraying, through the nozzles, a sealant to the lost circulation zone to fluidly seal the lost circulation zone; and determining, based on data generated by the camera representing an image of the lost circulation zone, at least one of (a) a condition of the lost circulation zone, (b) whether a sealing operation is required, or (c) a parameter of a lost circulation material to be used to perform a sealing operation.

20. A method comprising:

disposing, within a wellbore, a drill string comprising a housing and defining a first fluid pathway extending from the drill string, through a drill bit of the drill string, and out the drill bit, the drill string configured to direct a first lost circulation material along the first fluid pathway, the housing defining a volume configured to store a second lost circulation material, the drill string defining, with the housing, a second fluid pathway extending from the drill string, through the housing, and out the housing;

blocking the first fluid pathway; and flowing, with the first fluid pathway blocked, fluid along the second fluid pathway to flow the second lost circulation material out the housing to a lost circulation zone of the wellbore;

blocking the second fluid pathway; and flowing, with the second fluid pathway blocked, fluid along the first fluid pathway to flow the first lost circulation material out the drill bit to the lost circulation zone;

wherein the drill string further comprises one or more cameras residing at a surface of the drill string or the housing, and a plurality of nozzles fluidly coupled to the drill string and residing at a surface of the drill string or the housing, the method further comprising, after flowing the fluid along the second fluid pathway to flow the second lost circulation material:

spraying, through the nozzles, a sealant to the lost circulation zone to fluidly seal the lost circulation zone; and determining, based on data generated by the camera representing an image of the lost circulation zone, at least one of (a) a condition of the lost circulation zone, (b) whether a sealing operation is required, or (c) a parameter of a lost circulation material to be used to perform a sealing operation;

wherein the drill string further comprises a packer attached to the drill string and the determination comprises determining that a further sealing operation is required, the method further comprising, after spraying the sealant, expanding the packer to further seal or plug the lost circulation zone.

* * * * *